United States Patent [19]

Kuwahara et al.

[11] 4,231,337

[45] Nov. 4, 1980

[54] AIR INTAKE SYSTEM FOR DIESEL ENGINE

[75] Inventors: Akiyasu Kuwahara; Syozo Yanagisawa, both of Ibaraki, Japan

[73] Assignee: Hitachi, Ltd., Japan

[21] Appl. No.: 33,270

[22] Filed: Apr. 25, 1979

[30] Foreign Application Priority Data

Apr. 28, 1978 [JP] Japan ..... 53-49983
Jul. 14, 1978 [JP] Japan ..... 53-85161

[51] Int. Cl.[3] ..... F02M 25/06
[52] U.S. Cl. ..... 123/568
[58] Field of Search ..... 123/119 A

[56] References Cited

U.S. PATENT DOCUMENTS

| | | | |
|---|---|---|---|
| 3,135,253 | 6/1964 | Muhlberg | 123/119 A |
| 3,916,857 | 11/1975 | Naito et al. | 123/119 A |
| 3,934,564 | 1/1976 | Barnert | 123/119 A |
| 3,954,091 | 5/1976 | Stump | 123/119 A |
| 4,011,845 | 3/1977 | Mayer et al. | 123/119 A |
| 4,020,809 | 5/1977 | Kern et al. | 123/119 A |
| 4,031,873 | 6/1977 | Banzhaf et al. | 123/119 A |
| 4,043,304 | 8/1977 | Stump et al. | 123/119 A |
| 4,075,994 | 2/1978 | Mayer et al. | 123/119 A |
| 4,157,081 | 6/1979 | Wake et al. | 123/119 A |

*Primary Examiner*—Wendell E. Burns
*Attorney, Agent, or Firm*—Craig and Antonelli

[57] ABSTRACT

An air intake system for a Diesel engine has an air intake passage defined by a tubular wall in which EGR openings are formed for the recirculation of engine exhaust gases. The rate of the flow of the exhaust gases through the EGR openings is controlled by EGR valve which is rotatable with a throttle valve disposed in the air intake passage. Either when the engine temperature is lower than a predetermined temperature level or when the vacuum in the air intake passage downstream of the throttle valve with the latter being in its idle position exceeds a predetermined vacuum level in absolute value, either a bypass passage is open or the throttle valve is moved from the idle position to a more opened position, whereby the engine intake air is increased.

17 Claims, 10 Drawing Figures

AIR INTAKE SYSTEM FOR DIESEL ENGINE

BACKGROUND OF THE INVENTION

1. Field of the Invention

The present invention relates to an air intake system for a Diesel engine and, more particularly, to an air intake system for a Diesel engine equipped with an exhaust gas recirculation system.

2. Description of the Prior Art

There have been devised and demonstrated Diesel engines equipped with exhaust gas recirculation systems (which will be referred to as "EGR" system for brevity in this specification) in order to reduce the emission of nitrogen oxides (NOx) in the exhaust gases. In a typical prior art EGR system for the diesel engine, a part of the exhaust gases is recirculated back into an intake passage or induction passage in the vicinity of a throttle valve in an air intake system. More specifically, the exhaust gases to be recirculated are introduced into the intake or induction passage through openings formed in the wall of the air intake passage. The volume of the exhaust gases to be recirculated; that is, the recirculation rate, is controlled by an EGR valve means which is rotated in unison with the throttle valve so as to vary the opening degree of the exhaust gas recirculation openings. In general, the EGR valve means comprises a pair of valve plates which are made fast to the shaft of the throttle valve for rotation in unison therewith. The valve plates and the exhaust gas recirculation openings are so designed and arranged that the exhaust gases may be recirculated into the engine over all the operation range thereof. This means that the exhaust gases are recirculated into the engine also in the throttle part-open engine operation range. This adversely affects the cold-starting of an engine and the drivability of the engine during warm up operation. Furthermore, with the cold engine, the emission of the Diesel smoke is increased.

The EGR valve means of the type described has a further problem that, because the EGR openings are located adjacent to the side edges of the throttle valve, a considerably large amount of carbon contained in the exhaust gases is deposited on the surfaces of the throttle valve and the inner sufaces of the air intake passage so that the cross sectional area of the air intake passage is reduced. As a result, particularly during engine idling operation with a maximum throttle opening, the flow of the intake or fresh air is considerably reduced as compared with the flow of the exhaust gases recirculated; that is, the ratio between the amount of the fresh air and the amount of the recirculated exhaust gases varies with the resultant variation in air-fuel ratio and the increase in the emission of the unburned gas (HC). This adverse affect caused by the deposit of carbon may be eliminated by removing carbon deposit from the throttle valve and other parts, but it is almost inpractical to request engine operators to clean the air intake system frequently because carbon is accumulated continuously and gradually as the engine is operated and, consequently, cleaning services must be made at frequent intervals.

SUMMARY OF THE INVENTION

Accordingly, the main object of the present invention is to improve an air intake system for the Diesel engine equipped with EGR system so as to substantially overcome the above and other problems encountered in the prior art air intake systems.

Briefly stated, the most essential feature of the present invention resides in the provision, in an air intake system of the type described, of a means for increasing the flow of the intake air into the engine when the engine temperaure rises above a predetermined level or when the intake manifold vacuum (the absolute value) rises in excess of a predetermined level.

BRIEF DESCRIPTION OF THE DRAWINGS

Similar reference numerals are used to designate similar parts throughout the drawings.

DESCRIPTION OF PREFERRED EMBODIMENTS

Figure 1:
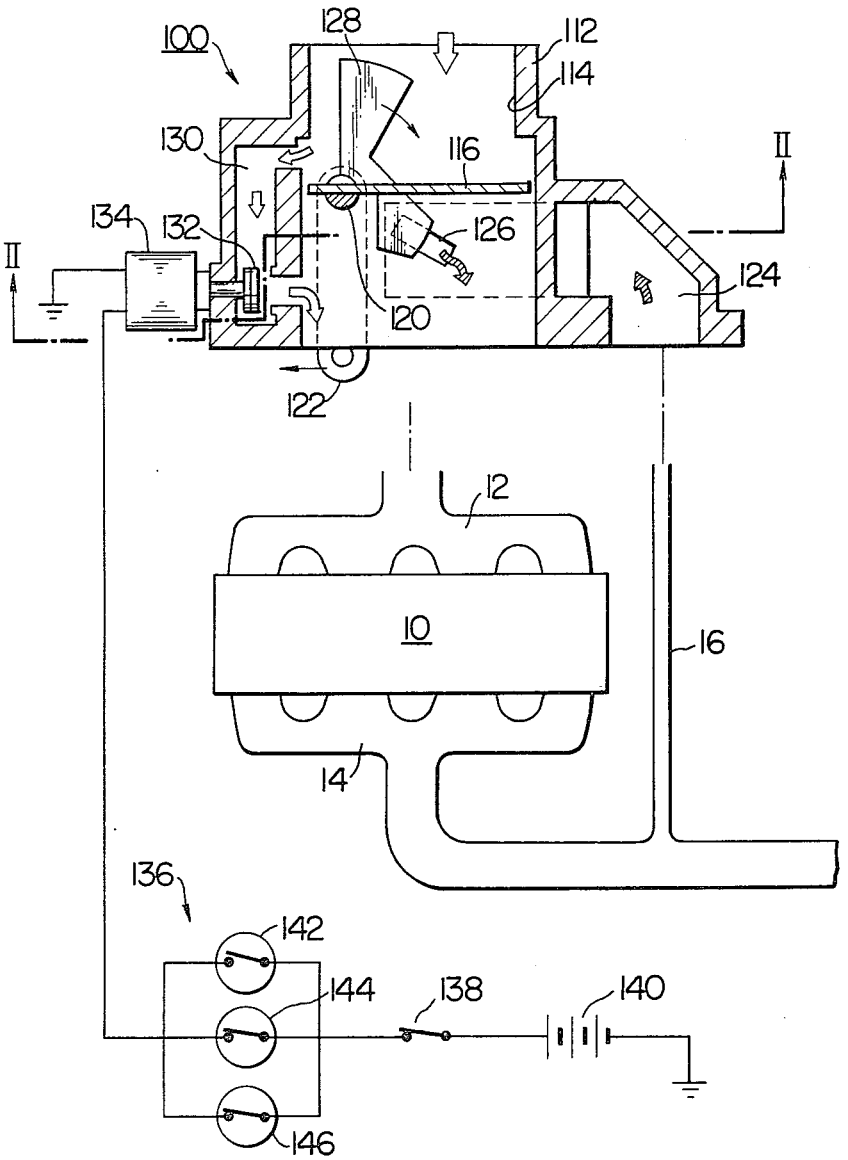
FIG. 1 is a schematic view, partly in section, of a first embodiment of an air intake system for Diesel engine in accordance with the present invention.
Figure 2:
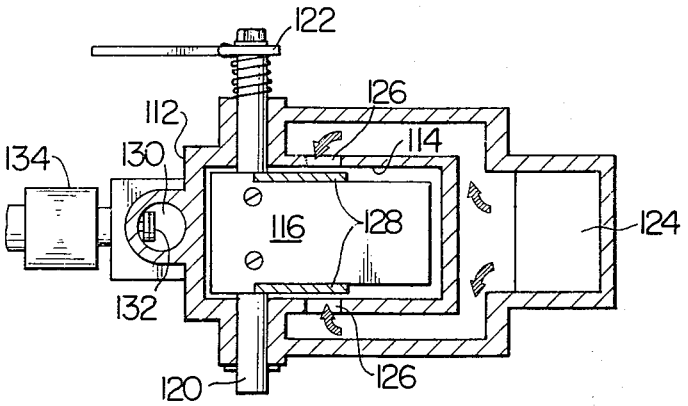
FIG. 2 is a sectional view taken along the line II—II in FIG. 1.

Referring to FIGS. 1 and 2, an air intake system 100 connected to the upstream end of an intake manifold 12 of a Diesel engine 10 includes a hollow main body 112 defining an air passage 114 therein. A butterfly type throttle valve 116 is rotatably carried by a shaft 120 within the air passage 114. As best shown in FIG. 2, the shaft 120 is rotatably mounted on the main body 112 and has its one end securely connected to a throttle lever 112 which in turn is operated by an acceleration device (not shown) of the engine so that the throttle valve 116 is rotated or swung from the idle position to the full throttle position and vice versa.

An EGR passage 124 which is formed externally of the air passage 114 is connected to the downstream end of an EGR pipe 16 which in turn is connected to an exhaust system 14 of the engine 10. As shown in FIG. 2, the EGR passage 124 extends in the shape of a letter U over substantially one half of the outer periphery of the tubular wall which defines the air passage 114. The tubular wall is formed with EGR openings 126 (Exhaust Gas Recirculation openings) in opposed relationship to the opposite side edges of the throttle valve 116 so that the EGR passage 124 may be communicated with the air passage 114 through these openings 126.

Plate members 128 are securely attached to the side edges of the throttle valve 116 substantially at right angles to both the plane of the throttle valve 116 and the axis of the shaft 120 to constitute EGR valves. The EGR valves 128 are therefore rotatable in unison with the throttle valve 116 about the axis of the shaft 120 to vary the opened areas of the EGR openings 126 and consequently control the rate of exhaust gases (EGR rate) to be recirculated to the engine 10 through the EGR passage 124 and the air passage 114. As is apparent from the shape of the EGR valve 128, the shape of the EGR openings 126 and the positional relationship between the EGR valve 128 and the EGR opening 126 shown in FIG. 1, when the throttle valve 116 is in its idle position shown in FIG. 1, the degree of opening of the EGR openings 126 is about 50% throttle. As the throttle valve 116 is rotated in the clockwise direction, the EGR openings 126 become fully opened. When the throttle valve 116 is opened to the full throttle position (which corresponds to the power range of the engine 10), the EGR openings 126 are substantially closed. Thus within the power range of the engine 10 the EGR rate is made as small as possible to avoid drop of the engine output power which would otherwise becaused, due to the exhaust gas recirculation.

An air intake system for the Diesel engine 10 with the above described design and construction has been well known in the art. In the case of a Diesel engine equipped with an air intake system which is simply of the type described, the ratio of the volume of exhaust gases to be recirculated to the volume of intake air is increased especially during engine operation with a small throttle opening; i.e., during idle operation, so that the results are the reduction in both the cold starting capability of the engine and the operational performance during warming up and the increase in Diesel smoke at cold starting and during warming up.

The first embodiment of the present invention has been devised in order to substantially overcome the above problems encountered in the Diesel engine equipped with the prior art air intake system of the type described above.

Referring again to FIGS. 1 and 2, the main body 112 of the air intake system 100 is provided with a bypass passage 130 formed in the side opposite the EGR passage 124 so as to permit the intake air to bypass the throttle valve 116. A bypass valve 132 is disposed within the bypass passage 130 so as to control the flow of the air through the bypass passage 130. More specifically, when the temperature of the engine 10 rises above a predetermined level, the bypass valve 132 is caused to open to permit the intake air to flow from the air passage 114 upstream of the throttle valve 116 through the bypass passage 130 to the air passage 114 downstream of the throttle valve 116. To this end, a bypass valve actuator 134 is operatively connected to the bypass valve 132 so that the latter is moved between a wide-open position and a fully closed position. In the first embodiment shown in FIGS. 1 and 2, the bypass valve actuator 134 comprises a solenoid 134 which in turn is electrically connected to an engine temperature sensing means 136 and to an electric power supply 140 through an engine switch 138. The engine temperature sensing means 136 which is employed in the first embodiment shown in FIG. 1 comprises a cooling water temperature sensor 142, an intake air temperature sensor 144 and an engine oil temperature sensor 146 all of which are connected in parallel. These sensors are so designed and arranged that, when the cooling water temperature, the intake air temperature and the engine oil temperature drop below predetermined levels, the contacts of these sensors are closed so as to pass the current. In the first embodiment shown in FIG. 1, the cooling water temperature sensor 142 is so set as to close its contacts when the cooling water temperature drops below 80° C. The intake air temperature sensor 144 is so set as to close its contacts when the intake air temperature drops below 20° C. The engine oil temperature sensor 146 is so set as to close its contacts when the engine oil temperature drops below 80° C. The solenoid 134 is so designed and arranged as to move the bypass valve 132 to its wide-open position when the solenoid 134 is electrically energized.

Next the mode of operation of the first embodiment with the above construction will be described. When the Diesel engine 10 is cold started or warmed up, the enigine switch 138 is turned on first. If the contacts of anyone of the sensors 142, 144 and 146 are kept closed when the engine switch 138 is turned on, the current flows into the solenoid 134 to energize it. As a result, the bypass valve 132 is moved to its wideopen position so that the intake air bypasses the throttle valve 116 in the manner described above and consequently additional intake air is supplied to the engine 10. Therefore, not withstanding the fact that the exhaust gases are recirculated in the engine 10 an improvement in the cold starting capability of the engine and a reduction in the volume of Diesel smoke are attained to ensure a satisfactory operation of the engine 10. As the engine 10 is warmed up, the cooling water temperature, the intake air temperature and the engine oil temperature all rise above predetermined levels so that the temperature sensors 142, 144 and 146 open their contacts. Consequently, the solenoid 134 is now de-energized so that the bypass valve 132 is moved to the fully closed position, thereby completely closing the bypass passage 130. The air intake system now resumes its normal operation.

As described above, the bypass passage 130 bypassing the throttle valve 116 of the air intake system 100 equipped with the EGR valves 128 is opened or closed depending upon the temperature of the engine 10 so that the cold starting capability is remarkably improved and the emission of Diesel smoke is minimized.

Figure 3:
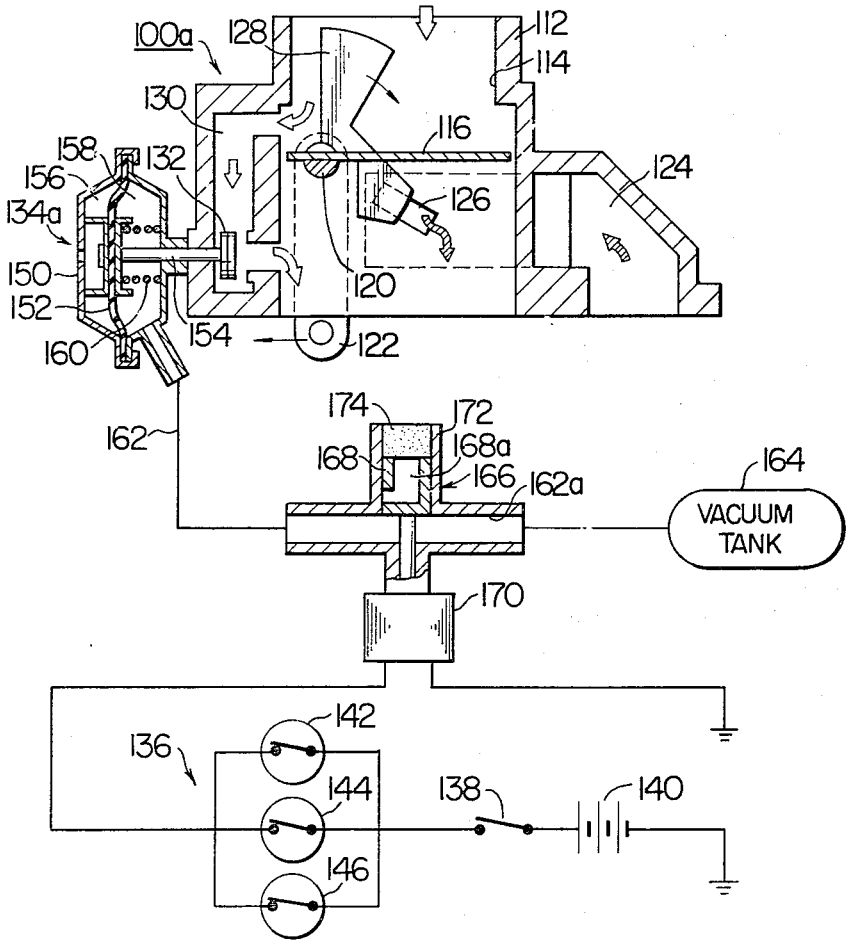
FIG. 3 is a schematic view, partly in section, of a first modification of the first embodiment shown in FIG. 1.

In FIG. 3 is shown a modification 100*a* of the first embodiment described above. In contrast to the first embodiment, the bypassvalve 132 in the modified air intake system 100*a* is actuated by a vacuum-operated actuator 134*a* which comprises a housing 150, a diaphragm 152 extending across the housing 150 to cooperate with the housing to define two chambers 156 and 158 on both sides of the diaphragm 152. The diaphragm 152 is connected by a bypass valve actuating rod 154 to the bypass valve 132. One chamber 156 is communicated with the surrounding atmosphere while the other chamber 158 is vacuum chamber. A compression spring 160 is disposed in the vacuum chamber 158 between the diaphragm 152 and one end wall of the housing 150 to bias the diaphragm toward the atmospheric pressure chamber 156.

The vacuum chamber 158 is communicated through a pipeline 162 to a vacuum tank 164 in which is provided a change-over valve 166 which selectively communicates the vacuum chamber 158 with the vacuum tank 164 or with the surrounding atmosphere. The valve 166 comprises a valve member 168, which is so designed and arranged as to move into and out of a passage 162*a* in the pipeline 162 transversely thereof, and a solenoid 170 for driving the valve member 168. The valve member 168 is formed therein with an inverted-L shaped passage 168*a*. A tubular port 172 is attached to the pipeline 162 so as to guide the transverse sliding movement of the valve member 168. A filter material 174 is inserted and securely held in position in an outer end of the tubular port 172 so as to avoid the entrance of the dust and the like into the pipeline 162. As is in the case of the first embodiment, the solenoid 170 is connected to the electric power source 140 through the engine temperature sensing means 136 and the engine switch 138.

Next the mode of operation of the modification 100*a* with the above construction will be described. Assuming that, anyone of the temperature sensors 142, 144 and 146 be kept closed when the engine 10 is cold started or warmed up, the electric current flows from the power source 140 to the solenoid 170 so that the latter is energized. As a result, the valve member 168 is caused to be inserted into the air passage 162*a* so that the vacuum chamber 158 of the vacuum actuator 134*a* is now communicated with the surrounding atmosphere through the passage 168*a* in the valve member 168 while the communication between the vacuum chamber 158 and the vacuum tank 164 is interrupted. Thus, the atmospheric pressure is transmitted into the vacuum chamber 158 so that the diaphragm 152 is deflected to the position shown in FIG. 3 by the force of the bias spring 160 and consequently the bypass valve 132 is displaced to the wide-open position shown in FIG. 3. As the engine temperature rises above a predetermined level, all of the temperature sensors 142, 144 and 146 open their contacts, as described above, so that the solenoid 170 is de-energized and consequently the valve member 168 of the change-over valve 166 is caused to slide transversely of the air passage 162*a* into the tubular port 172, thereby reestablishing the communication between the vacuum chamber 158 and the vacuum tank 164, as shown in FIG. 3. As a result, the vacuum chamber 158 is supplied with vacuum pressure so that the diaphragm 152 is deflected against the bias spring 160 and, consequently, the bypass valve 132 closes the bypass passage 130. Thus the air intake system 100*a* resumes the normal operation.

The modification 100*a* described above with reference to FIG. 3 may also remarkably improve the cold starting capability and reduce the emission of the Diesel smoke. The modification is advantageous over the first embodiment shown in FIG. 1 in that the electric power cunsumption is minimized because, as described above, the bypass valve 132 for opening or closing the bypass passage 130 is controlled by the vacuum-operated actuator 134*a* which in turn is controlled by the small-sized solenoid 170 which in turn is controlled in accordance with the engine temperature.

In both the first embodiment 100 and its modification 100*a*, the engine temperature has been described as being sensed or detected in terms of the temperatures of the cooling water, the intake air and the engine oil, but it is to be understood that only one of them may be measured to properly control the bypass valve 132.

Figure 4:
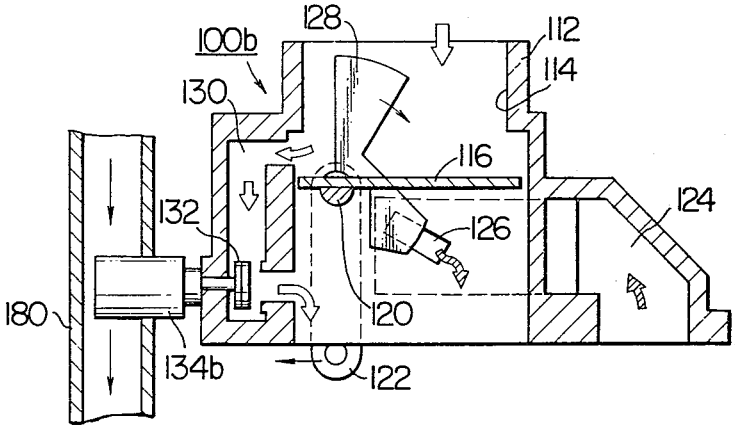
FIG. 4 is a fragmentary sectional view of a second modification.

In FIG. 4 is shown another modification 100*b* of the first embodiment 100. In this modification, the bypass valve 132 is directly operated and driven by a temperature sensitive or responsive element 134*b* which is disposed within a cooling water passage 180. The temperature sensitive or responsive element itself is of a conventional type made of wax and maintains the bypass valve 132 in its wide-open position, as shown in FIG. 4, when the engine cooling water temperature is below a predetermined level, so that additional intake air may flow through the bypass passage 130 to the engine 10. When the cooling water temperature rises beyond a predetermined level, the wax in the temperature sensitive or responsive element 134*b* is expanded so that the bypass valve 132 is moved to the right as viewed in FIG. 4 to close the bypass passage 130. Then the air intake system 100*b* resumes its normal operation.

The second modification shown in FIG. 4 may also additionally supply the fresh air through the bypass passage 130 when the engine temperature is below the predetermined level. In spite of the recirculation of engine exhaust gases at a low engine temperature, therefore, the cold starting capability is remarkably improved and the emission of the Diesel smoke is minimized.

Figure 5:
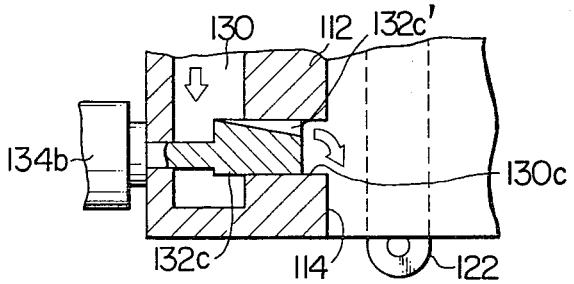
FIG. 5 shows a modification of a bypass control valve.
Figure 6:
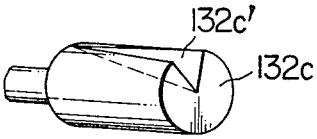
FIG. 6 is a perspective view of the modified bypass control valve shown in FIG. 5.

In the first embodiment 100 and its two modifications 100*a* and 100*b*, the bypass valve 132 disposed in the bypass passage 130 has been described as being of the type which is moved into and out of sealing engagement with a valve seat in the bypass passage. However it is to be noted that the bypass valve of the described type may be replaced by a valve plug 132*c* of a shape as shown in FIGS. 5 and 6. The valve plug 132*c* is substantially cylindrical and provided with an axial groove 132*c*′ formed in the outer peripheral surface. The groove 132*c*′ has a V-shaped cross-section whose depth is progressively increased from the rear end (that is, on the side of the valve stem) toward the leading end. The valve plug 132*c* is slidably fitted into a transverse opening 130*c* formed in the partition wall between the air passage 114 and the bypass passag 130 so as to intercommunicate them, and the valve stem is connected to the temperature sensitive or responsive element 134*b* as in the case of the second modification shown in FIG. 4. Thus, as the wax in the temperature sensitive or responsive element 134*b* expands or contracts, the valve plug 132*c* is axially moved in the transverse opening 130*c* so that the section of the air passage defined by the V-shaped groove 132*c*′ of the valve plug 132*c* and the cylindrical wall of the transverse opening 130*c* is gradually decreased or increased. Consequently, the flow rate of the fresh air bypassing the throttle valve 116 may be gradually reduced as the engine warm-up operation proceeds. Therefore, the drivability of Diesel engine during warm-up operation can be greatly improved.

According to the first embodiment of the present invention and its modifications, the Diesel engine equipped with the air intake system having EGR valves may considerably be improved in respect of the cold starting capability and the emission of Diesel smoke to assure reliable and efficient engine operation.

A second embodiment of the present invention will now be described with reference to FIGS. 7 to 10 in which parts similar to those of the first embodiment are designated by similar reference numerals.

The second embodiment of the air intake system according to the present invention is generally designated by 200 and includes a main body 112 which defines therein an air passage 114 in which a butterfly type throttle valve 116 is disposed and rotatably supported by a shaft 120 which is oepratively coupled to an accelerator (not shown) of the Diesel engine 10 by a lever 122 so that the throttle valve 116 may assume various throttling positions to control the flow rate of the air into the intake manifold 12 of the engine 10. A part of the exhaust gases is recirculated back into the air passage 114 from the exhaust system 14 of the engine 10 through the EGR pipe 16, the EGR passage 124 formed in the main body 112 and the EGR openings 126 formed in the partition walls between the air passage 114 and the EGR passage 124 in opposed relationship with the side edges of the throttle valve 116. The flow rate of the exhaust gases to be recirculated is controlled by EGR valve members 128. As is clear from FIG. 7, even when the throttle valve 116 is in its idle position, the EGR openings 126 are partly opened so that the exhaust gases may be recirculated into the intake system of the engine 10 even when the latter is in its idle operation.

After the air intake system of the type just described above is used for a long time, carbon contained in the exhaust gases flowing through the EGR passage 124 and the EGR openings 126 into the air passage 114 is deposited on the surfaces of the throttle valve 116 and EGR valve members 128 and over the inner surfaces of the air passage 114, so that the cross sectional area of the air passage 114 is decreased. As a result, espcially when the throttle valve 116 is in its idle position, the ratio of the flow of the recirculated exhaust gases to the flow of the fresh air is considerably increased as compared with normal conditions (in which there exists no carbon deposit) with a resultant increase in the emission of unburned gases (HC).

The second embodiment 200 of the present invention was made to substantially overcome this problem. Briefly stated, the most important feature of the second embodiment resides in the provision of a means for increasing the flow of fresh air into the engine 10 when the absolute value of the intake manifold vacuum of the engine 10 rises beyond a predetermined level.

Referring again to FIG. 7, the main body 112 has a bypass passage 230 through which the fresh air may bypass the throttle valve 116. A bypass valve 232 is disposed within the bypass passage 230 so as to open or close the same, thereby controlling the communication between the sections of the air passage 114 upstream and downstream of the throttle valve 116. The bypass valve 232 is connected by a valve rod 234 to a diaphragm-operated actuator 240. The actuator 240 includes a diaphragm 242 which is clamped between a pair of dish-shaped housing parts 244 and 246 to cooperate therewith to define a vacuum chamber 248. A compression spring 250 is disposed in the vacuum chamber 248 between the diaphragm 242 and the housing part 244 to bias the diaphragm 242 toward the right as viewed in FIG. 7.

The vacuum chamber 248 of the actuator 240 is pneumatically connected through a pipe line 252 to a vacuum port 254 open to the air passage 114 downstream of the throttle valve 116. A solenoid-operated valve 260 and a check valve 270 are provided in the pipe line 252 in the order named. The solenoid-operated valve 260 is electrically connected to a throttle position sensor 280 which comprises a limit switch having contacts (not shown) adapted to be closed by the throttle lever 122 when the throttle valve 116 is brought to a position in the vicinity of its idle position. When the sensor 280 is closed, the electric current passes from the power supply 140 through the engine switch 138 to a coil 262 of the solenoid-operated valve 260 whereby the valve 260 is actuated.

The solenoid-operated valve 260 has a vacuum port 264 in communication with the check valve 270, an atmospheric port 266 communicated with the surrounding atmosphere and a valve spool 268 which is movable to open the vacuum port 264 while closing the atmospheric port 266 and vice versa. More specifically, when the coil or solenoid 262 is energized, the valve spool 268 is brought to the position shown in FIG. 7. thereby covering the atmospheric port 266 while uncovering the vacuum port 264 so as to communicate the vacuum chamber 248 of the actuator 240 with the check valve 270. When the contacts of the limit switch, which is the throttle position sensor 280, are opened, the coil or solenoid 262 is de-energized so that the valve spool 268 is moved to another position, thereby covering the vacuum port 264 while uncovering the atmospheric port 266 so as to introduce the atmospheric air into the vacuum chamber 248 of the actuator 240.

The check valve 270 comprises a disk-like member 272 made of an elastic material such as rubber so that it is deformed only when the absolute value of the vacuum in the air passage 114 downstream of the throttle valve 116 rises beyond a predetermined level (i.e., when the rate of the flow of intake air is decreased to an abnormal extent due to the deposit of carbon on various parts of the intake system) to cause the vacuum port 254 to be communicated with the solenoid-operated valve 260.

Therefore, when the throttle valve 116 is in its idle position so that the throttle position sensor 280 is in its electrically conductive state to energize the solenoid-operated valve 260 and if the vacuum in the air passage 114 downstream of the throttle valve 116 exceeds the vacuum level determined by the check valve 270, this check valve is opened, so that the vacuum is transmitted through the solenoid-operated valve 260 to the vacuum chamber 248 of the actuator 240. As a result, the diaphragm 242 is deflected to the left as viewed in FIG. 7 against the bias spring 250, so that the rod 234 and hence the valve 232 are shifted to the left and, consequently, the downstream end of the bypass passage 230 is opened to such a degree as to correspond to the vacuum in the air passage 114 downstream of the throttle valve 116. Thus, additional fresh air can be supplied through the bypass passage 230 to the engine 10 so as to compensate for the decrease in the flow of the fresh air past the throttle valve 116 caused by the carbon deposit described above.

According to the second embodiment of the present invention described above, if the vacuum in the air passage 114 downstream of the throttle valve 116 abnormally rises during engine idle operation beyond the predetermined vacuum level, an additional fresh air can be supplied through the bypass passage 230 into the engine. As a result, even if the cross-sectional area of the air passage particularly during engien idle operation is reduced because of the carbon deposit, the total supply of fresh air into the engine will not be reduced, so that the ratio between the flow of the fresh intake air and the flow of recirculated exhaust gases remains unchanged and, consequently the air-fuel ratio may be always maintained in desired range. When the throttle valve 116 is opened wider for medium or high engine speed, the throttle position sensor 280 is rendered electrically non-conductive so that the solenoid-operated valve 260 is de-energized, with a result that the vacuum chamber 248 of the actuator 240 is communicated with the surrounding atmosphere as described above. As a consequence, except the engine idle operation (including engine operation substantially similar to idle operation), the vacuum in the air passage 114 downstream of the throttle valve 116 will not be transmitted to the vacuum chamber 248 of the actuator 240, so that the bypass passage 230 remains closed by the valve 232. In addition, a check valve 270 is provided in the vacuum pipeline 252 between the vacuum port 254 at the downstream point of the throttle valve 116 and the solenoid-operated valve 260 and is arranged such that only when the level (absolute value) of the manifold vacuum (that is, the vacuum in the air passage 114 downstream of the throttle valve 116) rises above a level determined by the check valve 270 and when the degree of the opening of the throttle valve 116 is less than the degree of opening determined by the throttle position sensor 280, the manifold vacuum is transmitted to the vacuum chamber 248 of the actuator 240. Therefore, the valve 232, which opens and closes the bypass passage 230, is prevented from causing any chattering.

Figure 7:
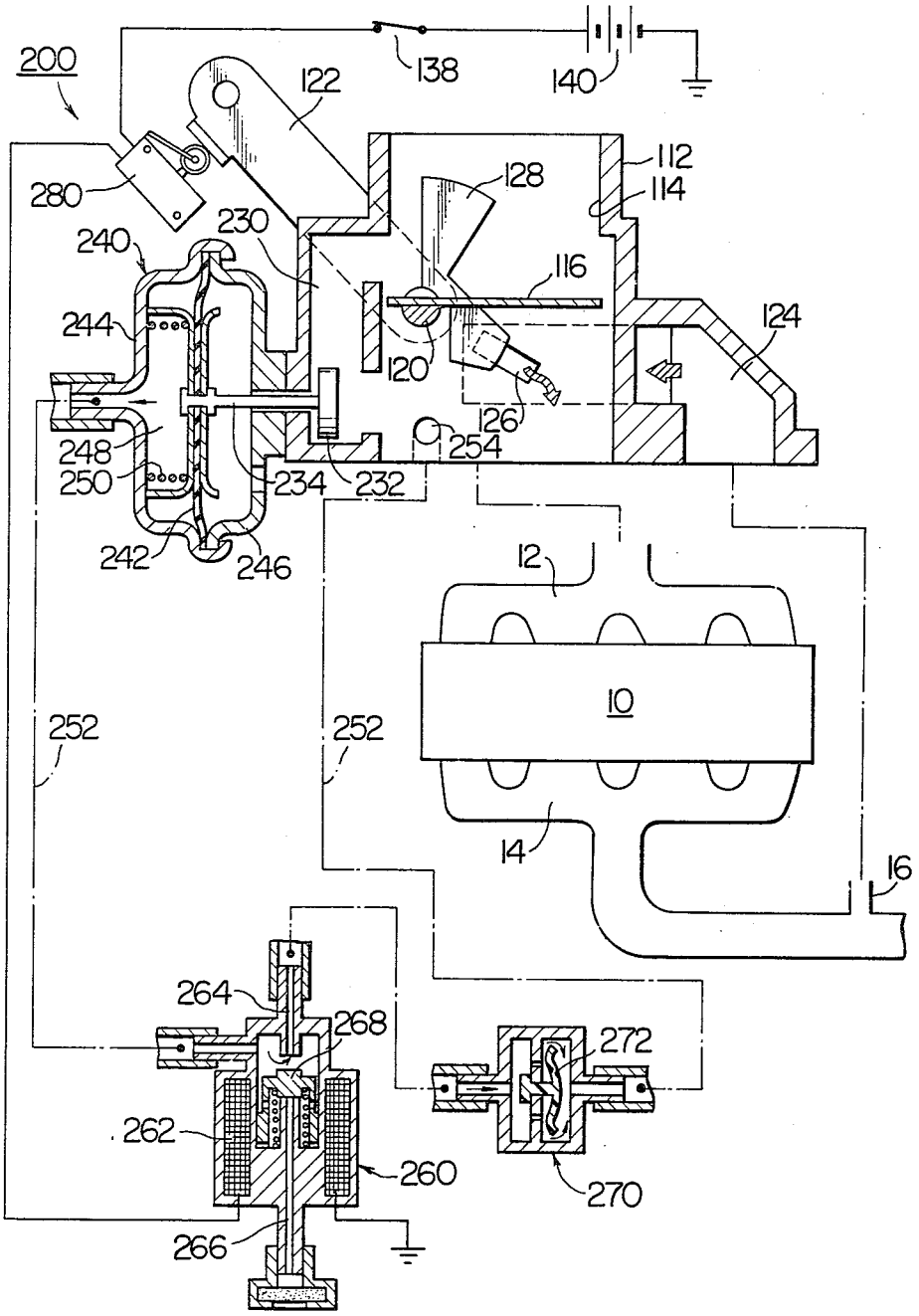
FIG. 7 is a schematic view, partly in section, of a second embodiment of the present invention.
Figure 8:
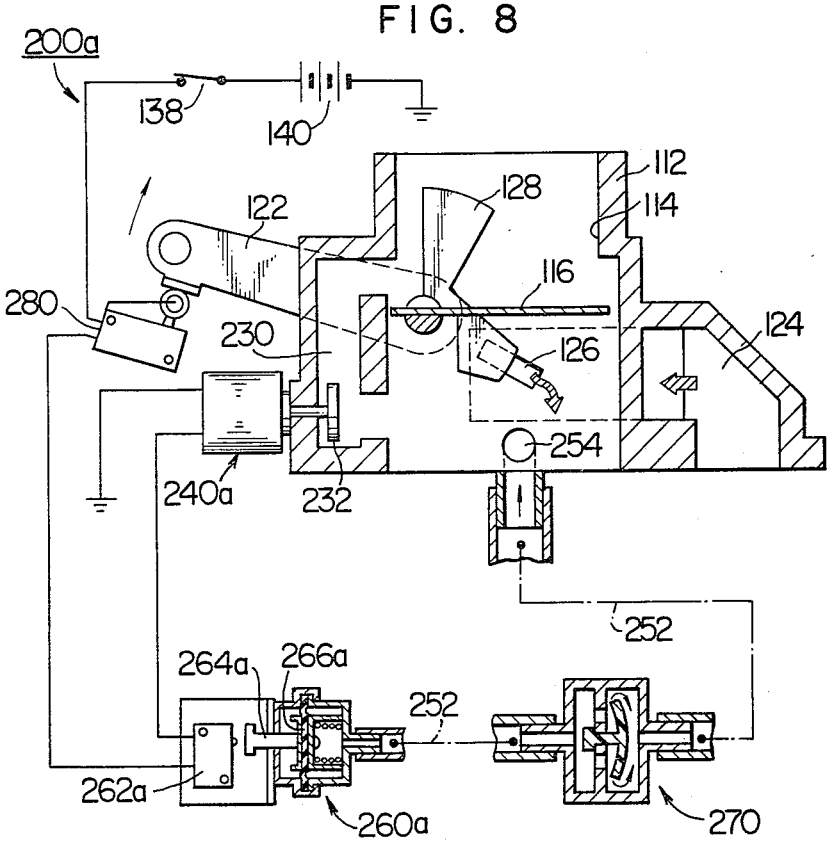
FIG. 8 is a schematic view, partly in section, of a first modification of the second embodiment.

In FIG. 8 is shown a modification 200*b* of the second embodiment 200 of the invention described above with reference to FIG. 7. In the modified air intake system 200*b*, a solenoid 240*a* is used as an actuator for operating the valve 232 which opens and closes the bypass passage 230. The solenoid 240*a* is electrically connected through a vacuum-operated switch means 260*a* to the throttle position sensor 280. The switch means 260*a* comprises an electric switch 262*a* with contacts (not shown) and a diaphragm actuator 266*a* which has a switch actuating rod 264*a* and has its one chamber communicated with the check valve 270 of the type described above. Therefore, when the vacuum in the air passage 114 downstream of the throttle valve 116 rises to a level high enough to open the check valve 270, the actuating rod 264*a* of the diaphragm actuator 266*a* is moved to the right as viewed in FIG. 8 to turn the switch 262*a* on, so that the solenoid 240*a* is energized to shift the valve 232 to the full open position.

The modification shown in FIG. 8 is advantageous over the second embodiment shown in FIG. 7 in that the vacuum line may be shortened so that the response of the bypass valve 232 may be considerably improved and, consequently, the engine response may be faster.

Figure 9:
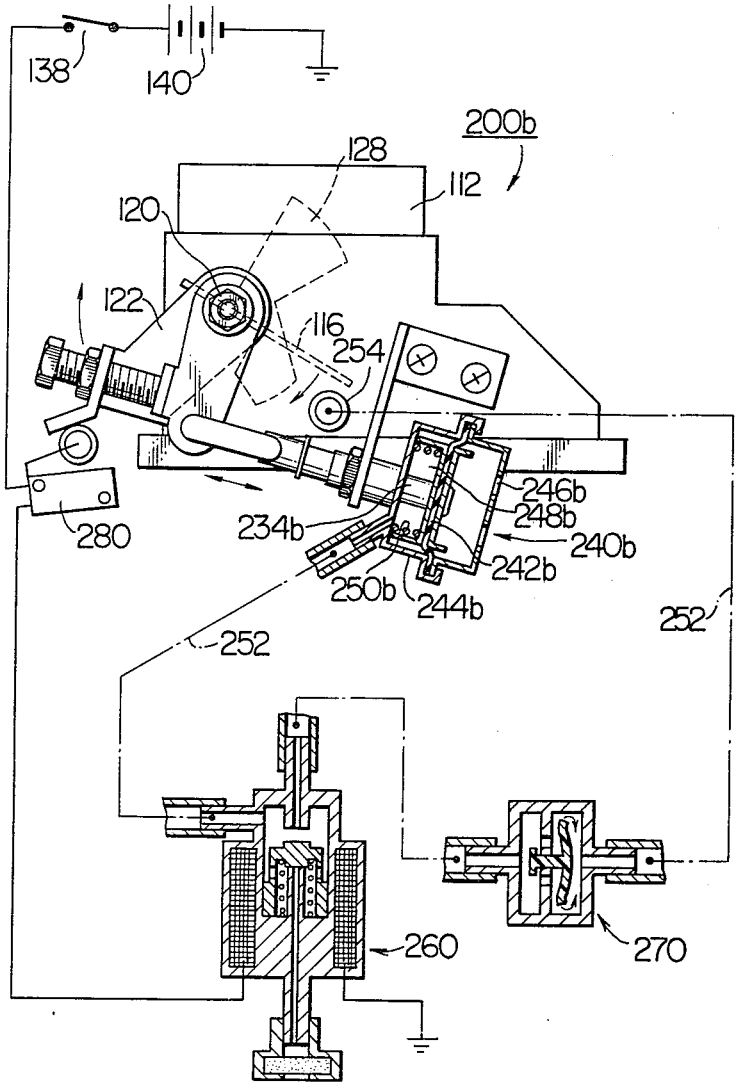
FIG. 9 is a schematic view, partly in section, of a second modification of the second embodiment of the present invention.

FIG. 9 shows another modification 200*b* of the second embodiment 200 shown in FIG. 7. The modification 200*b* is different from the air intake systems shown in FIGS. 7 and 8 in that the bypass 230 and the bypass valve 232 are eliminated. The modification 200*b* is designed such that, when the vacuum (is absolute value) in the air intake passage downstream of the throttle valve 116 rises above a predetermined level during engine idle operation, the degree of opening of the throttle valve 116 itself is increased so as to increase the flow of the fresh air through the air passage 114 into the engine. More particularly, one end of the shaft 120 of the throttle valve 116 is connected to one end of an actuating rod 234*b* of a vacuum-operated actuator 240*b* comprising a diaphragm 242*b* and a housing consisting of housing parts 244*b* and 246*b*. The outer end of the rod 234*b* is connected to the diaphragm 242*b* of the actuator 240*b*. The diaphragm 242*b* cooperates with the housing part 244*b* to define a vacuum chamber 248*b* in which a compression spring 250*b* is disposed. The vacuum chamber 248*b* is communicated through a pipeline 252 with the vacuum port 254 which opens to the air passage 114 downstream of the throttle valve 116. The check valve 270 and the solenoid-operated valve 260, both of which are described in detail with reference to FIG. 7, are disposed in the pipeline 252.

Figure 10:
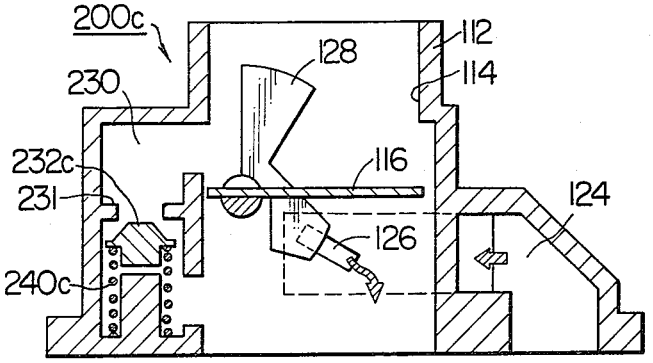
FIG. 10 is a fragmentary sectional view of a third modification of the second embodiment of the invention.

FIG. 10 shows a further modification 200*c* of the second embodiment 200. As in the second embodiment 200 and its modification 200*a* shwon in FIGS. 7 and 8, respectively, the modified air intake system 200*c* has a bypass passage 230 having an annular valve seat 231 provided between the upstream and downstream ends of the bypass passage 230 open to the air passage 114 at points upstream and downstream of the throttle valve 116, respectively. A frustoconical valve member 232*c* is disposed in the bypass passage 230 downstream of the valve seat 231 and resiliently biased by a compression spring 240*c* normally against the valve seat 231.

When the vacuum in the air passage 114 downstream of the throttle valve 116 rises above a predetermined level set by the bias spring 240*c*, the valve member 232*c* is moved downwardly away from the valve seat 231 against the spring 240*c* so that additional fresh air is allowed to flow through the bypass passage 230 into the engine. This modification is also operative to compensate for an insufficient air flow past the throttle valve 116 due to the carbon deposit as described above.

What is claimed is:

1. An air intake system for a Diesel engine, comprising:

a main body defining therein an air passage;

a throttle valve pivotally mounted in said air passage;

at least one EGR opening formed in the peripheral wall of said air passage for the recirculation of engine exhaust gases back into said air passage;

an EGR valve means operatively associated with said throttle valve to vary the rate of the flow of the recirculated exhaust gases through said EGR opening in accordance with the operating conditions of the engine;

said EGR opening being at least partially open by said EGR valve means when said throttle valve is in its idle position; wherein the improvement comprises means for increasing the rate of the flow of intake air into said engine when the engine is at a temperature lower than a predetermined temperature.

2. The air intake system according to claim 1, wherein said intake air increasing means comprises:

(a) a bypass passage extending, in bypassing relationship to said throttle vale, between the portions of said air passage upstream and downstream of said throttle valve;

(b) a bypass valve means comprising a valve member disposed in said bypass passage; and (c) a valve actuator means responsive to the engine temperature to move said valve member to its open position when the engine temperature is below said predetermined temperature.

3. The air intake system according to claim 2, wherein said valve actuator means comprises:

(a) a solenoid operatively associated with said valve member;

(b) an electric power source; and (c) an engine temperature sending means disposed in an electric circuit extending between said solenoid and said electric power source.

4. The air intake system according to claim 2, wherein said valve actuator means comprises:

(a) a pneumatic actuator operatively associated with said valve member;

(b) a change-over valve operative to control the application of pneumatic pressure to said pneumatic actuator;

(c) a second solenoid operative to actuate said second solenoid;

(d) an electric power source; and (e) an engine temperature sensing means disposed in an electric circuit extending between said second solenoid and said electric power source.

5. The air intake system according to claim 4, wherein said pneumatic actuator is a vacuum-operated actuator and includes a diaphragm connected to said valve member disposed in said bypass passage, said diaphragm defining a vacuum chamber pneumatically connected by a vacuum pipeline to a vacuum source, said change-over valve being disposed in said vacuum pipeline.

6. The air intake system according to claim 2, wherein said valve actuator means comprises a temperature sensitive element including a portion formed of a material which is expanded and contracted when the engine temperature is varied.

7. The air intake system according to claim 6, wherein said bypass valve means is arranged such that the rate of the air flow through said bypass passage is gradually decreased as the volume of said temperature sensitive portion of said temperature sensitive element is increased due to a temperature rise in the engine.

8. An air intake system for a Diesel engine, comprising:

a main body defining therein an air passage;

a throttle valve pivotally mounted in said air passage;

at least one EGR opening formed in the peripheral wall of said air passage for the recirculation of engine exhaust gases back into said air passage;

an EGR valve means operatively associated with said throttle valve to vary the rate of the flow of the recirculated exhaust gases through said EGR opening in accordance with the operating conditions of the engine;

said EGR opening being at least partially open by said EGR valve means when said throttle valve is in its idle position; wherein the improvement comprises means for increasing the rate of the flow of intake air into said engine when the vacuum in said air passage downstream of said throttle valve with the latter being in a predetermined position substantially corresponding to its fully closed position is increased beyond a predetermined vacuum level.

9. The air intake system according to claim 8, wherein said intake air increasing means includes:

(a) a bypass passage extending, in bypassing relationship to said throttle valve, between the portions of said air passage upstream and downstream of said throttle valve; and (b) a valve member movably disposed in said bypass passage.

10. The air intake system according to claim 9, wherein said intake air increasing means further includes:

(a) a valve seat provided in said bypass passage upstream of said valve member; and (b) means biasing said valve member toward said valve seat.

11. The air intake system according to claim 9, wherein said intake air increasing means further includes:

(a) a valve actuator operative to move said valve member between open and closed positions; and (b) an actuator control means operative to energize said valve actuator to move said valve member to said open position when said throttle valve is closed to said predetermined position and the vacuum in said air passage downstream of said throttle valve is increased beyond said predetermined vacuum level.

12. The air intake system according to claim 11, wherein said valve actuator is a vacuum-operated actuator, and wherein said actuator control means includes:

(a) a vacuum pipeline pneumatically connecting said vacuum-operated actuator to said air passage downstream of said throttle valve;

(b) a check valve disposed in said vacuum pipeline and opened when the vacuum in said air passage downstream of said throttle valve exceeds said predetermined vacuum level;

(c) a change-over valve disposed in said vacuum pipeline between said check valve and said actuator; and (d) a throttle position sensing means operative to emit a signal to said change-over valve when said throttle valve is closed to said predetermined position;

said change-over valve being operative to pneumatically connect said vacuum-operated actuator to said check valve when said change-over valve receives a signal from said throttle position sensing means.

13. The air intake system according to claim 12, wherein said change-over valve includes a solenoid and a valve member driven by said solenoid, an wherein said throttle position sensing means comprises a limit switch disposed in an electric circuit between said solenoid and an electric power source and being operatively associated with said throttle valve.

14. The air intake system according to claim 11, wherein said valve actuator comprises a solenoid, and wherein said actuator control means includes:

(a) a first electric switch disposed in an electric circuit between said solenoid and an electric power source;

(b) a second electric switch disposed in said electric circuit between said first switch and said solenoid;

(c) a vacuum-operated switch actuator associated with said second switch and pneumatically connected by a vacuum pipeline to said air passage downstream of said throttle valve; and (d) a check valve disposed in said vacuum pipeline and opened when the vacuum in said air passage downstream of said throttle valve exceeds said predetermined vacuum level;

said first switch being operatively associated with said throttle valve so that said first switch is rendered electrically conductive when said throttle valve is closed to said predetermined position; and said second switch and said vacuum-operated switch actuator being arranged such that said second switch is rendered electrically conductive when said check valve is opened.

15. The air intake system according to claim 8, wherein said intake air increasing means includes:

(a) a throttle valve actuator drivingly connected to said throttle valve; and (b) an actuator control means operative to energize said throttle valve actuator to move said throttle valve from said predetermined position to a more opened position when the vacuum in said air passage downstream of said throttle valve exceeds said predetermined vacuum level.

16. The air intake system according to claim 15, wherein said throttle valve actuator is a vacuum-operated actuator, and wherein said actuator control means includes:

(a) a vacuum pipeline pneumatically connecting said vacuum-operated actuator to said air passage downstream of said throttle valve;

(b) a check valve disposed in said vacuum pipeline and being opened when the vacuum in said air passage downstream of said throttle valve exceeds said predetermined vacuum level;

(c) a change-over valve disposed in said vacuum pipeline between said check valve and said actuator; and (d) a throttle position sensing means operative to emit a signal to said change-over valve when said throttle valve is closed to said predetermined position;

said change-over valve being operative to pneumatically connect said vacuum-operated actuator to said check valve when said change-over valve receives a signal from said throttle position sensing means.

17. The air intake system according to claim 16, wherein said change-over valve includes:

(a) a solenoid valve; and (b) a valve member adapted to be driven by said solenoid, and wherein said throttle valve sensing means comprises a limit switch disposed in an electric circuit between said solenoid and an electric power source.

* * * * *